US006203012B1

(12) United States Patent
Peron

(10) Patent No.: US 6,203,012 B1
(45) Date of Patent: Mar. 20, 2001

(54) PROTECTIVE HOUSING FOR DISCARDED PLAYING CARDS

(76) Inventor: Alan Peron, 26 Quiet Desert La., Henderson, NV (US) 89014-3241

( * ) Notice: Subject to any disclaimer, the term of this patent is extended or adjusted under 35 U.S.C. 154(b) by 0 days.

(21) Appl. No.: 09/238,526

(22) Filed: Jan. 27, 1999

Related U.S. Application Data

(60) Provisional application No. 60/072,684, filed on Jan. 27, 1998.

(51) Int. Cl.[7] ..... A63F 1/10
(52) U.S. Cl. ..... 273/148 A; 273/148 R
(58) Field of Search ..... 273/148 A, 148 R, 273/150

(56) References Cited

U.S. PATENT DOCUMENTS

| | | | | |
|---|---|---|---|---|
| D. 86,168 | | 2/1932 | Heusser et al. . | |
| D. 164,862 | * | 10/1951 | Johnson | 273/148 A |
| 847,570 | * | 3/1907 | Granger | 273/148 A |
| 2,222,245 | | 11/1940 | Steen . | |
| 2,961,240 | | 11/1960 | Ablett . | |
| 3,185,482 | | 5/1965 | Russell . | |
| 3,658,342 | | 4/1972 | Boren . | |
| 3,678,602 | | 7/1972 | Alam . | |
| 4,163,559 | | 8/1979 | Stenstrom . | |
| 4,558,865 | | 12/1985 | Isgar . | |
| 5,186,464 | | 2/1993 | Lamie . | |
| 5,685,543 | * | 11/1997 | Garner | 273/148 A |

OTHER PUBLICATIONS

"Casino Products", 1995 catalog, p. 13, Oct. 1995.*

* cited by examiner

*Primary Examiner*—Benjamin H. Layno

(57) ABSTRACT

A protective housing for playing cards is provided for use with table games requiring restricted access to the discarded playing cards during the continued play of the game. An outer cover is provided, with a lower opening configured to enable the outer cover to be slidably received by a playing card discard holder, which is typically anchored to the gaming table. A card receiving slot is formed in an upper portion of the cover, enabling continued access to the playing card holder by the dealer to deposit discards during the play of the game. Access to the discarded playing cards received by the discard holder is restricted pending removal of the outer cover by the dealer.

11 Claims, 1 Drawing Sheet

PROTECTIVE HOUSING FOR DISCARDED PLAYING CARDS

CROSS-REFERENCE TO RELATED APPLICATION

This application claims the benefit of U.S. Provisional Application Ser. No. 60/072,684, filed Jan. 27, 1998.

BACKGROUND OF THE INVENTION

1. Field of the Invention

The present invention relates to playing card holders and, more particularly, for holders of the type as are particularly desirable for use in card games in which a discard pile is generated during play of the game. More specifically, the present invention relates to a playing card holder for receiving and storing discarded playing cards during play of the game in a manner that limits player access to the discarded playing cards.

2. Description of the Prior Art

The increasing popularity of wagering, along with the accompanying increases in the dollar volume of wagers placed, has required a heightened sense of awareness on the part of casino security personnel. Nowhere is this more evident than in those wagering games where members of the public, or the dealers, are permitted physical contact with the random event determinator. Whether the wagering game employs dice or playing cards, permitting access to such random event determinators invites the possibility of their corruption, resulting in the casino losing its house advantage.

Such undetected corruption recently resulted in a series of casino loses associated with the game of Baccarat. Using playing cards divided into two hands, the goal in Baccarat is to obtain hands of a certain numerical value. Having rules of play that are even less complex than Blackjack, Baccarat is the least controllable table game from the perspective of the house. On certain wagers, Baccarat provides the slimmest of house edges.

Although explained below in the context of Baccarat, Mini-Baccarat, and Blackjack (also known as "Twenty-One"), other playing card games also present a casino with a risk of cheating through playing card manipulations. In games such as Blackjack, after play of a particular hand has been completed, all of the playing cards are collected and placed into a discard pile. With player and dealer attention focused on the dealing and play of the next hand, the discarded playing cards are at risk of being surreptitiously removed, marked, and then replaced by players sitting at that table. As can be imagined, actual knowledge of particular playing card identity can at times greatly assist in card play and betting strategy during subsequent hands using those "marked" cards.

Baccarat arrived in the United States from the glamorous casinos of Europe, and perhaps intimidated most American players by the ambiance and regal air surrounding the game. Played in a formal, full-pit setting, the European version uses a long table with 12 to 14 players, a dealer, three croupiers, with formal attire the norm. Such a game plays to only a limited market in U.S. casinos.

To widen the market for Baccarat, American casinos have provided a dressed-down version: "Mini-Baccarat," which uses the same game rules, but is played on a standard Blackjack-size table with six players, one dealer, and much less protocol. Additionally, most casinos apply lower betting limits for mini-baccarat, hoping to attract novice players to the game.

Both Baccarat and Blackjack have playing cards dealt from a deck by a dealer to form individual hands—two in Baccarat and two or more in Blackjack. A two-card hand is initially dealt in both games, with additional cards added at either the player's option (Blackjack, player's hand) or based upon minimum hand point values (Blackjack, dealer's hand; both hands in Baccarat). The point value assigned to each of the different playing cards is based upon the nominal value of the "numbers" card, with the "face" cards assigned either a value of "ten" (Blackjack) or "zero" (Baccarat).

Play of the hands varies slightly between the two; however, in both it would be greatly beneficial for the player to know the value of face-down playing cards prior to their being turned. In Blackjack, a player must determine whether to accept another card from the deck, or simply stand and wait for the dealer's play. In Baccarat, the player bets after the two hands are dealt, but prior to their values revealed.

Blackjack and Baccarat share another feature, both provide the house with its narrowest edge, near 6% in Blackjack and even less in Baccarat. After the initial deal, Baccarat provides for drawing no more than a total of three cards for either hand. When both hands have been played out, the hand closest to NINE wins, with winning BANKER and PLAYER bets paid even money (1 to 1), and a 5% commission taken from winning BANKER bets (payoff ratio of 19:20). TIE bets are usually paid at 8 to 1. Since the PLAYER hand is always played out first, the BANKER hand is given a slight edge, winning 50.7% to the PLAYER 49.3%, tie bets excluded. The 5% commission taken on BANKER wins results in a house edge of 1.17% on BANKER bets, and a 1.36% edge on PLAYER bets (TIES included).

Since Baccarat and Blackjack offer the lowest house edges of the casino table games, very little in terms of "corruption" is required before the edge shifts to the player. The ability in Baccarat to place higher bets only further aggravates the temptation to manipulate the natural odds favoring the house.

Once the play of hand has been completed, the playing cards are collected and placed in a discard pile. Play continues, and after the completion of many such hands, the discards are reshuffled prior to their replacement in the card-holding "shoe" for use in further games. While in the discard pile, the playing cards are vulnerable to surreptitious removal by someone at the table. Once removed, the playing card(s) can be "compromised," and then quietly returned to the discard pile for later use in the game after reshuffling.

This vulnerability of discarded playing cards also exists with the casino game of Twenty-One or Blackjack. As mentioned previously, the ability to discern the value of the potential draw cards, or the dealer's cards, can be of great value in these games as well. To minimize the opportunities for such removal/replacement, the discards must be at a location on the table that makes their unobserved removal awkward in some manner, yet continues to provide for their unobstructed visibility, at all times, to the players and to the dealer.

SUMMARY OF THE INVENTION

It is an object of the present invention to restrict access to the discarded playing cards in a manner that maintains their visibility to the players, as well as permits easy access to them by the dealer when shuffling is required.

In this regard, an inner discard holder is nested within a removable outer protective cover. Card entry slots are formed in the outer cover, permitting placement of the playing cards within the outer cover during play of the game.

Such discarded playing cards fall upon the discard holder, which maintains a degree of order among the playing cards as they accumulate within the outer protective cover. At the conclusion of the game, or when reshuffling is required, the outer protective cover is removed, providing the dealer with easy access to the accumulated playing card discards.

Some further objects and advantages of the present invention shall become apparent from the ensuing description and as illustrated in the accompanying drawings.

DETAILED DESCRIPTION OF THE PREFERRED EMBODIMENTS

Figure 1:
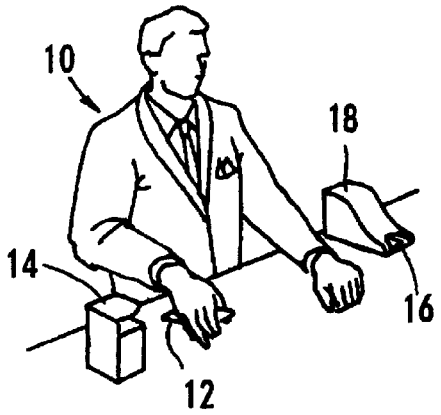
FIG. 1 is a perspective view showing the manner of use of a discard protector in accordance with the present invention.

Reference is now made to the drawings wherein like numerals refer to like parts throughout. A dealer 10 is shown in FIG. 1 placing a discarded playing card "discard" 12 into a discard protector 14. The discard 12 was originally taken from a deck of playing cards 16 stored within a playing card holder or "shoe" 18. After play of a hand has been completed in a particular game, such as Baccarat or Blackjack, the discards 12 are removed from the playing area and are placed within the discard protector 14.

Figure 2:
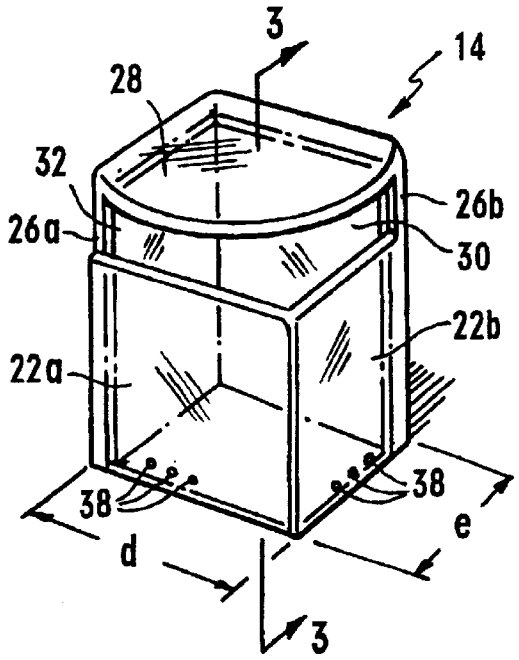
FIG. 2 is an enlarged perspective view showing a discard protector in accordance with the present invention.

As is best shown by reference to FIG. 2, the discard protector 14 is generally rectangular-cubic in shape, having a pair of front side walls 22*a*, 22*b*, a pair of rear side walls 26*a*, 26*b*, and a top wall 28. In a preferred embodiment there is no bottom wall, permitting the discard protector 14 to be slidably received by an underlying discard holder 30.

Placement of the discards 12 (not shown in FIG. 2) within the discard protector 14 is through a card receiving slot 32 formed between the pair of front side walls 22*a*, 22*b* and the top wall 28. To enhance ease of entry of the discard playing cards 12 into the discard protector 14, it is preferred that the card receiving slot 32 extend over both of the pair of front side walls 22*a*, 22*b*. However, it is to be understood and appreciated that an extension of the card receiving slot 32 over only one or a portion of one such side walls would also be sufficient so long as entry of the playing card discards 12 may occur in an unbent manner.

Figure 3:
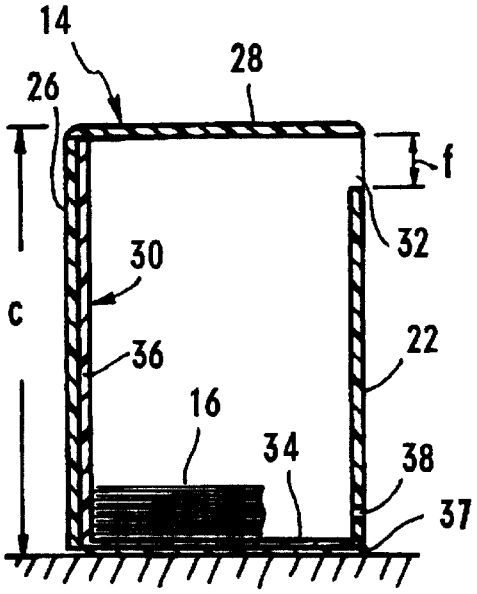
FIG. 3 is a partial cross-sectional view taken along line 3—3 in FIG. 2, showing a discard protector in accordance with the present invention.

Turning now to FIG. 3, once placed within the card receiving slot 32, the discards 12 descend, and ultimately rest upon a card-receiving floor 34 of the discard holder 30, and against a pair of adjoining corner support walls 36. This latter structure insures that the discards 12 will remain in an orderly pile as they accumulate on the card-receiving floor 34. Such an orderly arrangement considerably simplifies the task of re-shuffling the discards 12 at the time of refilling the shoe 18.

The discard holder 30 is frequently provided by the casino as a repository for the discards of many different kinds of playing card games. To prevent their removal from a particular table, or their movement about the table during a game, the discard holder 30 is frequently attached to the table, either by an adhesive layer 37, as in FIG. 3, or by metal fasteners, such as by one or more screws (not shown).

In addition to this structural arrangement of the corner support walls 36 of the discard holder 30, the dimensions of the discard holder 30 and of the discard protector 14 are selected to ensure the orderly, internal accumulation of the discards 12. Once entering the card receiving slot 32, the discarded playing cards 12 are received within the discard protector 14 in a manner that is intended to prevent tumbling as the discards 12 descend towards the card-receiving floor 34 of the discard holder 30.

To further enhance the stability of such discarded playing cards 12 after their having been received by the discard holder 30, a pair of air passageways 38 are preferably formed in each of the pair of front side walls 22*a*, 22*b* of the discard protector 14. To the extent that air residing within the discard protector 14 resists or is partly compressed by the dropping discarded playing card 12, the air passageways 38 provide a means for such air to escape from within the discard protector 14.

Such air movement out of the discard protector 14 through the air passageways 38 equalizes the air pressure on both sides of the discard 12. In this manner the air passageways 38 enhance the stability of the discarded playing card 12 as it falls into place on the card-receiving floor 34 of the discard holder 30 received within the discard protector 14 (see FIG. 4).

In a preferred embodiment, the discard protector 14 is molded out of No. 2423 Red Acrylic having a thickness of ¼□ (6 mm).

Figure 4:
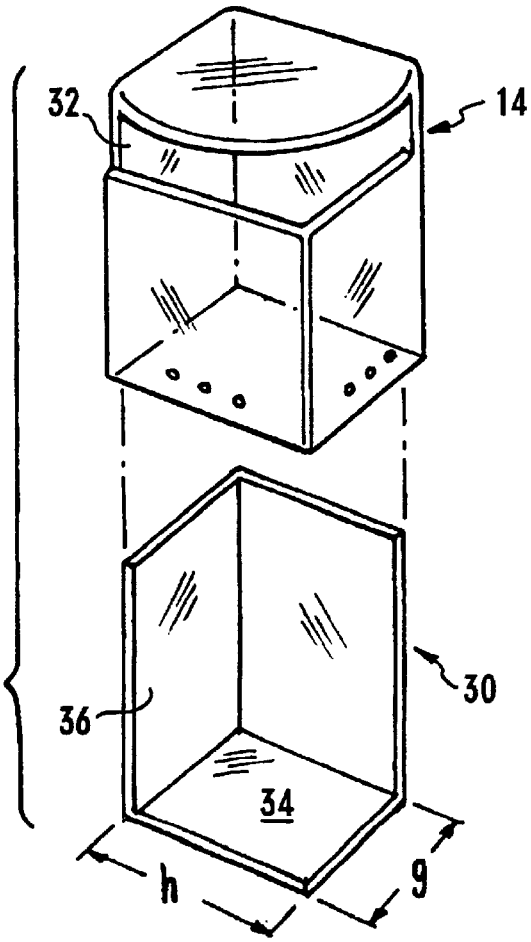
FIG. 4 is an exploded, perspective view showing the manner in which a discard protector is received by a discard holder in accordance with the present invention.

Turning again to FIG. 3, the overall height "c" of the discard protector 14 is preferably 12–14 cm for use in Baccarat or Mini-Baccarat and 8½–11 cm for games requiring a smaller number of decks, such as Blackjack. When conventionally-sized playing cards are used, a base width "d" of 8½ cm and a base length "e" of 7 cm (see FIG. 2) are preferred. For ease of placement of the discards 12 within the discard protector 14, the card receiving slot 32 forms an opening "f" of preferably 2 cm (FIG. 3). Additionally, equalization of air pressure within the discard protector 14 as the discard 12 descends within can be obtained by providing the air passageways 38 having a diameter of 7 mm. The dimensions of the conventionally-used discard holders 30 are appropriate for being received within the overlying discard protector. As is shown in FIG. 4, when conventional playing cards are used, the card receiving floor has a base width g of 6.7 cm and a base length h of 9.5 cm.

My invention has been disclosed in terms of a preferred embodiment thereof, which provides an improved playing card discard protector that is of great novelty and utility. Various changes, modifications, and alterations in the teachings of the present invention may be contemplated by those skilled in the art without departing from the intended spirit and scope thereof. It is intended that the present invention encompass such changes and modifications.

I claim:

1. A protective housing for discarded playing cards comprising:

an outer protective cover having a card-receiving slot defined therein, said outer protective cover further defining a top portion and a bottom, playing card-receiving portion, said bottom portion providing substantially unimpaired access to interior portions of said outer protective cover.

2. A protective housing according to claim 1, wherein at least one aperture is formed in said outer protective cover at a location substantially adjacent said bottom playing card-receiving portion.

3. A protective housing according to claim 1, wherein said outer protective cover is substantially cubic in configuration and wherein said card receiving slot extends through at least one corner thereof.

4. A protective housing according to claim 3, wherein said top portion is rectangular in cross section and wherein said card receiving slot diagonally extends across a pair of opposing corners of said top portion.

5. A protective housing according to claim 4, wherein said bottom playing card-receiving portion is configured as an open rectangle.

6. A playing card protector comprising:

an outer protective cover, said outer protective cover includes an upper portion and a lower portion, said upper portion having a card receiving slot formed therein, wherein a plurality of apertures are formed in said lower portion of said outer protective cover; and an inner playing card holder nested within and removably receiving said outer protective cover, said inner playing card holder comprises a pair of receiving walls, each of said pair of walls slidably receiving corresponding portion of said outer protective cover, wherein said pair of receiving walls lie adjacent one another, forming a receiving corner holder, and further comprising a receiving floor attached to and extending from said pair of receiving walls, and wherein said receiving floor is attached to a playing surface.

7. A playing card protector according to claim 6, wherein said outer protective cover substantially defines a cubic-quadrilateral and wherein said lower portion inscribes an open rectangle therein.

8. A playing card protector according to claim 7, wherein said inner playing card holder is received within the open rectangle of said lower portion.

9. A playing card protector according to claim 8, wherein said card receiving slot extends through a corner formed in said upper portion.

10. A playing card protector according to claim 9, wherein said card receiving slot extends along an oblique line between a pair of opposed corners of said upper portion.

11. A cover for a discard playing card holder comprising:

an open end container having an upper portion and a lower portion, said upper portion having a card receiving slot formed therein and said lower portion and said open end defining a receiving opening having dimensions corresponding to a set of lateral dimensions of said discard playing card holder, whereby the discard playing card holder is received within the open end container in a manner permitting the continued reception of playing cards through the card receiving slot formed in the upper portion of said container.

* * * * *